United States Patent [19]

Valentin

[11] Patent Number: 4,930,254

[45] Date of Patent: Jun. 5, 1990

[54] LOCK FOR SLIDER MECHANISM

[76] Inventor: Siegfried W. Valentin, Melrose Dr., Chester, N.J. 07930

[21] Appl. No.: 258,567

[22] Filed: Oct. 17, 1988

[51] Int. Cl.[5] ..... E05D 15/22

[52] U.S. Cl. ..... 49/181; 49/176

[58] Field of Search ..... 49/181, 445, 172, 176

[56] References Cited

U.S. PATENT DOCUMENTS 4,364,199 12/1982 Johnson ..... 49/181

4,644,691 2/1987 Wright ..... 49/181

FOREIGN PATENT DOCUMENTS 0721066 11/1965 Canada ..... 49/181

*Primary Examiner*—Joseph Falk

*Assistant Examiner*—Gerald Anderson

*Attorney, Agent, or Firm*—Darby & Darby

[57] ABSTRACT

The present invention relates to a locking device for use with the slider mechanisms of a window. In prior slider mechanism of the type described, a potential problem exits where the dimensions of the slider mechanisms changes. For example, in the case of a window, if the frame pieces bow outwardly due to warping, heat, stress, etc., as can happen where the frame is of plastic material, the window sash can fall out of the frame. In the present invention there is a carriage which rides in an elongated channel of the window and a bracket attached to the sash which slide relative to the frame. The channel has lips which overlie its edges. A coupling member, or connector, is provided having one end which is connected to the bracket and another end with a neck which is fitted to the carriage. The coupling member neck also has a pair of outwardly extending arms which fit into the channel. The arms extend transversely to the elongated direction of the channel. If there is a change in dimension of either of the window pieces, the arms of the coupling engage and lock against the channel lips and prevent the sash from being separated from the frame having the channel.

5 Claims, 3 Drawing Sheets

LOCK FOR SLIDER MECHANISM

Background of the Invention

The present invention relates to a locking device for use with slider mechanisms. The various applications which use such slider mechanisms include, for example, windows, sliding shutters, cabinetry, etc.

In slider mechanisms of the type under consideration, a slider carriage of low friction material operates within a channel of one part and forms a bearing surface so that a second part can slide relative to the part in which the carriage rides. For example, in the case of the window previously mentioned, the window frame has a channel and the slider mechanism carriage rides within this channel. The window sash has connected to it a piece which couples it to the slider carriage so that as the window sash is raised or lowered, the carriage permits a smooth sliding action.

In prior slider mechanisms of the type described, a potential problem exits where the dimensions of one or both of the pieces having a part of the slider mechanisms changes. For example, in the case of a window, if the frame pieces bow outwardly due to warping, heat, stress, etc., as can happen where the frame is of plastic material, the window sash can fall out of the frame.

BRIEF DESCRIPTION OF THE INVENTION

The present invention relates to an improved slider mechanism of the type in which there is a carriage which rides in an elongated channel of a frame of one piece, such as a window or a cabinet frame, and a bracket attached to the other piece which is to slide relative to the piece having the channel. The channel of the one piece has lips which overlie its edges. A coupling member, or connector, is provided having one end which is connected to the bracket and another end with a neck which fits in a mating mounting slot of the carriage. The coupling member neck also has a pair of outwardly extending arms which fit into the channel of the one piece in which the carriage rides. The arms extend transversely to the elongated direction of the channel. If there is a change in dimension of either of the pieces, the arms of the coupling engage and lock against the channel lips and prevent the piece having the bracket to which the coupling member is attached from being separated from the piece having the channel.

OBJECTS OF THE INVENTION

It is therefore an object of the present invention to provide an improved slider mechanism.

Another object is to provide an improved slider mechanism for one piece which is to slide relative to another piece with the mechanism having a coupling member which prevents the on piece from becoming detached from the other piece.

A further object is to provide an improved slider mechanism having a bracket attached to the sliding piece with a connecting coupling having cross arms which fit within a channel in the other piece in which the carriage of the slider mechanism moves.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
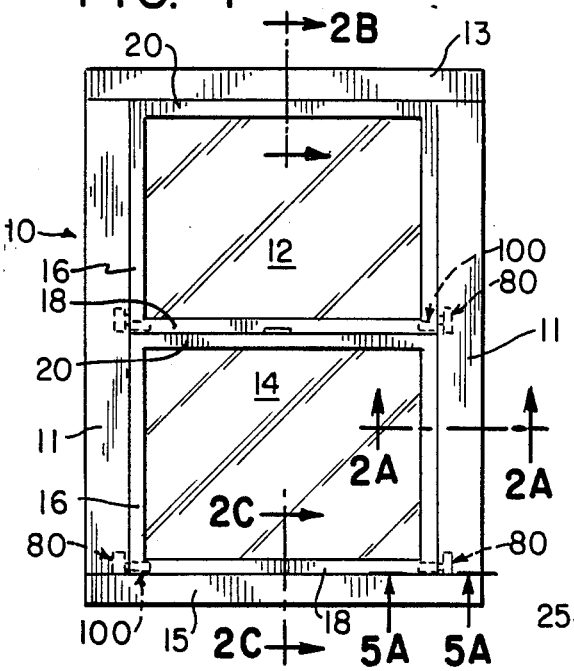
FIG. 1 is an elevational view of a window showing a typical use of the slider mechanism.
Figure 2A:
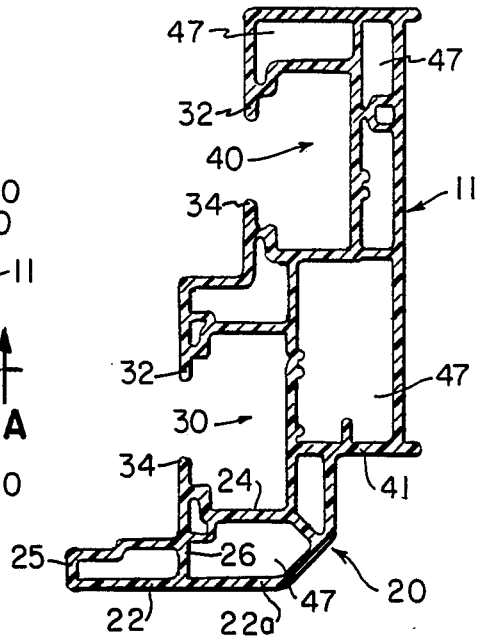
FIG. 2A is a cross-section of the vertical rail of the channel of a window frame in which the carriage rides and, FIGS. 2B and 2C are cross-sections of the upper and lower members of the window frame.
Figure 2B:
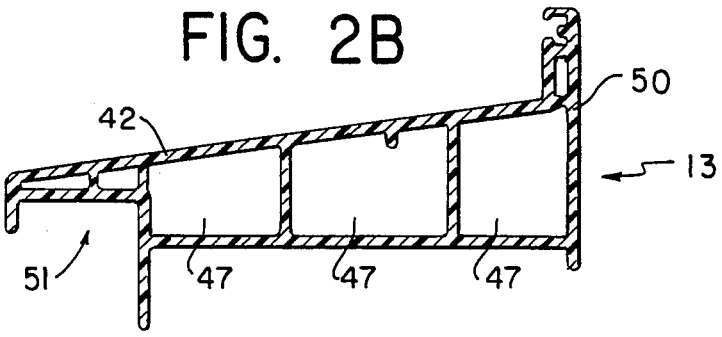
Figure 2C:
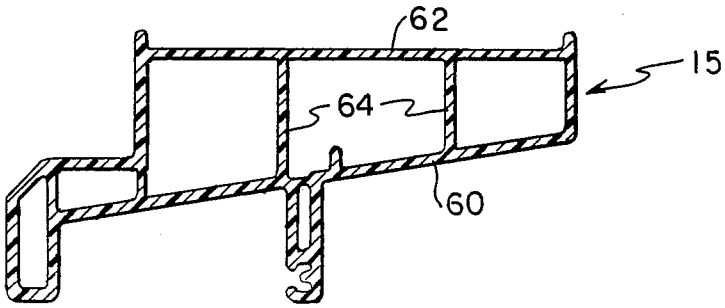

FIG. 1 shows a typical window frame 10, whose various parts are shown in cross section in FIGS. 2A, 2B, 2C. While the invention is described with reference to a window frame having a channel, it is equally applicable to any part having such a channel, for example, a door which slides relative to the frame of a cabinet.

The frame 10 can be, for example, of plastic, metal or wood. It has two parallel vertical rails 11 between which are connected upper and lower horizontal members 13, 15. In the preferred embodiment being described, the frame is for a window designed to be of the double hung sash type, that is, it holds upper and lower window sashes 12 and 14. Sashes 12, 14 have the usual vertical side rails 16 and horizontal bottom and top rails 18 and 20 between which a glass, usually some type of an insulated glass, is held. In the case of the invention being used with a cabinet, the sashes 12, 14 would correspond to doors. The windows themselves and the frames form no part of the present invention.

The cross section of a typical vertical frame rail 11 is shown in FIG. 2A. The frame is of plastic which can be formed by molding on by extrusion. The vertical frame rail 11 has an outer facing mullion 20 which is shown formed by an outer and inner walls 22 and 24 which are connected at one end 25 and also at the center by a cross piece 26. The mullion 20 turns inwardly with the inner wall 24 forming a generally C-shaped first channel 30 having outwardly extending lips 32 and 34 which overlap the edges of the channel. Thereafter the inner wall 24 makes a reverse bend to define a generally C-shaped second channel 40 which extends parallel to the first channel 30 and is somewhat offset from it toward the outside of the frame. The second channel 40 also has lips 32 and 34 which overlap its edges. Typically, the lower window sash 12 is to slide relative to the inner channel 30 and the upper sash relative to the outer channel 40.

The outer surface 22 of each vertical frame member 11 continues and has any desired shape depending upon the shape of the building requirements. Generally, there is a single piece **22*a* which extends across the length of the channel 40 and part way across channel 30. A bridging reinforcing wall 41 connects the outer and inner walls 22 and 24** between the two channels.

Air pocket spaces 47 are provided on both the sides and the back of the two channels 30 and 40 between the inner and outer walls 22 and 24 to provide for better insulation. The size of the air spaces can be as desired. Also, if desired, suitable insulation, e.g., foam, etc. can be placed into these spaces. Again, the construction of the frame 10 is not truly part of the present invention.

The cross section of the horizontal upper frame piece 13 is shown in FIG. 2B and also included a mullion 50 to correspond to the mullion 25 of the vertical frame piece 11. It also has an outer and inner walls 42 and 44 which are joined together by various cross pieces. The inner wall 44 has a generally C-shaped channel 51 to accept the top horizontal rail 20 of the upper window sash 14. As with the vertical frame pieces, there are insulating air pocket space 47 between the inner and outer walls of the inner and outer walls.

The lower frame piece 15 is generally similar to the upper frame piece 13 and includes outer and inner walls 60 and 62 which are joined together by any suitable cross pieces 64. The inner wall 62 is slanted somewhat to accept the bottom edge of the lower rail 20 of the bottom window sash 14 and form a seal therewith.

Figure 3:
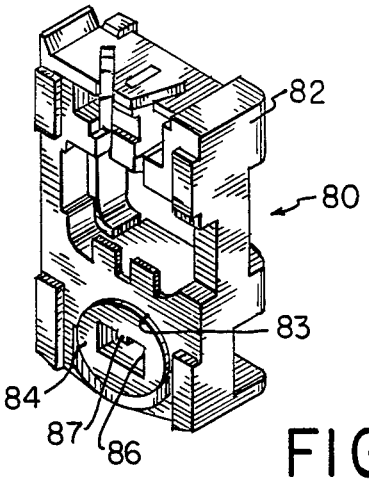
FIG. 3 is a perspective view of the slider carriage.

The slider mechanism includes a carriage 80 of a known type as shown in FIG. 3, which is to be coupled to the bottom of each of the upper and lower sashes 12 and 14. That is, each sash is to have a carriage coupled to its lowermost corner. The carriage 80 preferably has an outer body 82 of one piece plastic construction, the plastic having good sliding properties, e.g., TEFLON, nylon, etc. The exact shape of the slider body is not critical but it is sized so as to fit and freely slide within a respective one of the channels 30 or 40 of the vertical members 11 of the frame 10.

The bottom of the slider carriage body 80 has a cylindrical opening 83 in which is located a rotatable pivot piece 84. The pivot piece has a generally rectangular central keyhole opening 86 with a rib 87 in the center thereof. The pivot 84 can be rotated by 360° and has an internal latching mechanism which will preferably latch with the keyhole opening 86 in the vertical (lengthwise) position, in which it lies along the length of a channel 30 or 40, or in the horizontal position, in which it has transverse to the channel and the elongated direction of lips 32, 34 thereof.

Figure 4:
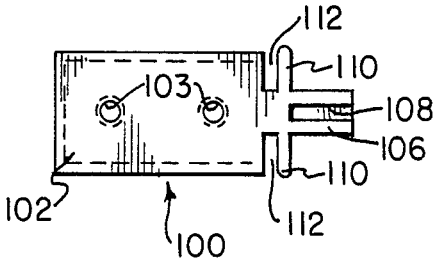
FIG. 4 is a plan view of the coupling and locking member.
Figure 5A:
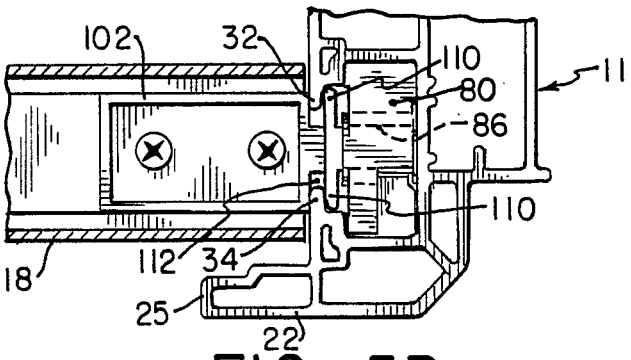
FIGS. 5A and 5B show the positioning of a sash in the frame.
Figure 5B:
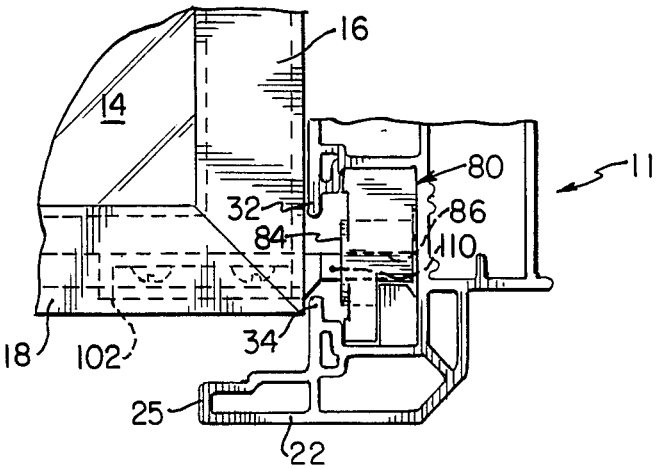

A coupling and locking connector 100 is provided between the window sash and carriage 80 and is shown in detail in FIG. 4. It is of a piece of material of good strength, preferably of metal, which is either machined or cast. It has a main body 102 of a shape and size which permits it to be mounted into a bottom rail of each of the upper and lower window sashes. The central body 102 of the connector is of generally rectangular shape and has a pair of holes 103 through which fasteners extend to attach the connector to the appropriate window sash bottom rail. A generally rectangular post 106 extends outwardly from the body 102. The top face of the post 106 has a depressed groove 108 of a size corresponding to the rib 87 of the pivot 84 of the slider carriage 80. When the connector 100 is mounted to the window sash, the post 106 extends completely beyond the sash vertical rail 16 into the corresponding channel 30 or 40.

Extending transversely from the connector post 106 are a pair of cross arms 110. There is a space 112 between the rear surfaces of the cross arms 110 and the connector body 102 which is wide enough to accept the lips 32, 34 of the corresponding one of the channels 30, 40 of the frame vertical pieces 16 within which the post 106 of a corresponding connector 100 rides.

In the operation of the slider mechanism, the frame is shipped with the slider carriages 80 in place in the channels 30, 40. The carriages also can be inserted at the job site, this being accomplished by removing the channel lips 32, 34 at a location usually at the top of the frame, to permit the carriages to be dropped into the channels. The coupling pieces 100 are also attached to each corner of the corresponding lower rail of the upper and lower sashes.

To mount a window sash within a frame, the pivots 84 of the pair of slider carriages 80 on the opposite vertical frame rails 16 are turned to a position such that the pivot piece slots 86 are vertical. The sash is laid generally horizontal and the posts 106 are inserted into the slots 86 making sure that each groove 108 of a post matches the rib 87 in the keyhole slot. This is done one post at a time with the connector 100 on each side of the sash. To insert the second post, the unconnected carriage can be raised slightly and the sash tilted so that the post can be inserted into that carriage.

After the insertion of the two posts on the opposite corners of the sash is completed, the cross-arms 110 also lie along the length of the respective channel 30 or 40. The overlapping side lips 34, 36 of the channel 30 or 40 do not at this time obstruct the coupling piece cross arms 110.

Thereafter, the window sash is rotated by about 90° . to a vertical position. The upper corners of each sash has conventional releasable members to hold the sash relative to the frame. Each connector 100 rotates the pivot 84 of its corresponding carriage 80 and the cross arms 110 are rotated to lie within but generally transverse to the vertical channel 40 or 42. In this position, the cross arms 110 lie behind the lips 32, 34 of the channel. The lips fit within the space 112 between the cross arms 110 and the central body 102 of the coupling 100. This arrangement prevents the sash from moving sideways and becoming disengaged from the window frame at any time. That is, even if the vertical frame members 11 bow outwardly, the sash will still be coupled to the frame and will not fall out. This occurs because of the connector on each bottom corner of a sash cross arms 110 engage the channel lips 32, 34. That is, the extent of bowing or warping of the frame is constricted by the cross arms 110 extending from the central body 102 of the connector which is fixedly attached to the window. If, for example, the cross pieces 110 were not present and the side rails of the window frame expanded for some reason, the posts of the connectors 100 would detach from the carriages and the sash could drop out of the frame. This occurred in the prior art frame sometimes during shipping.

I claim:

1. A slide mechanism for sliding a first piece relative to a second piece having an elongated channel with at least one lip overlying the channel, comprising a carriage of low friction material for sliding within and along said channel, said carriage having a rotatable member with an aperture which is rotatable from a first position to a second position, a connector having a central body portion fixedly attached to said first piece and a post extending outwardly from said central body to extend into said channel and into the aperture of the carriage rotatable member to couple said connector to said carriage and to provide for rotation of the rotatable member from a first to a second portion upon rotation of said first piece, and a pair of arms one extending outwardly from each side of said connector post with a space between the arms and the connector body so that the channel lip lies in said space and an arm lies behind the lip of the channel in the channel when the carriage rotatable member is in its first position and the first piece is free for being moved along the length of the channel of said second piece with the connector extending arm riding behind the channel lip for preventing the first piece from falling out of the channel by an arm engaging said lip, the carriage rotatable member when said first piece has been rotated to place the carriage rotatable member in its second position aligning the connector extending arms to be along the length of the channel so that the first piece can be detached from said carriage and moved past the lip of the channel.

2. A slide mechanism as in claim 1 wherein said first piece is a window sash and said second piece is a window frame, said window sash being in a substantially vertical position when said rotatable member of the carriage is in its said first position and in a substantially horizontal position when said rotatable member of the carriage is in its said second position.

3. A slide mechanism as in claim 2 wherein the second piece has a lip on each side of the channel and one arm of the connector can engage in said lip.

4. A slider mechanism as in claim 1 further comprising mating means on said carriage rotatable member and said post for coupling said connector to said carriage rotatable member with a predetermined orientation.

5. A slide mechanism as in claim 4, wherein said mating coupling means comprises a projection on the wall of the rotatable member surrounding the aperture and an indent on the post into which the connector fits.

* * * * *